US006015266A

United States Patent [19]

Swatek

[11] Patent Number: 6,015,266

[45] Date of Patent: Jan. 18, 2000

[54] REACTIVE MATERIAL RECIPROCATING SUBMERSIBLE PUMP

[75] Inventor: Mike Allen Swatek, Claremore, Okla.

[73] Assignee: Baker Hughes Incorporated, Houston, Tex.

[21] Appl. No.: 08/918,978

[22] Filed: Aug. 27, 1997

[51] Int. Cl.[7] ..... F04B 45/00

[52] U.S. Cl. ..... 417/53; 417/412

[58] Field of Search ..... 417/53, 375, 392, 417/412

[56] References Cited

U.S. PATENT DOCUMENTS

| | | | |
|---|---|---|---|
| 3,702,067 | 11/1972 | Stewart | 60/326 |
| 4,018,547 | 4/1977 | Rogen . | |
| 4,472,113 | 9/1984 | Rogen . | |
| 5,288,214 | 2/1994 | Toshio et al. | 417/395 |
| 5,334,629 | 8/1994 | Zirino . | |
| 5,398,917 | 3/1995 | Carlson et al. | 267/140.14 |
| 5,515,085 | 5/1996 | Hideo et al. . | |
| 5,534,186 | 7/1996 | Walker et al. . | |

FOREIGN PATENT DOCUMENTS

| | | | |
|---|---|---|---|
| 365011 | 4/1990 | European Pat. Off. . | |
| 59-2331180 | 12/1984 | Japan | 417/412 |
| 962-671A | 10/1982 | U.S.S.R. | 60/326 |
| 1151058 | 5/1969 | United Kingdom . | |
| 96/02276 | 2/1996 | WIPO . | |

*Primary Examiner*—Charles G. Freay
*Assistant Examiner*—Cheryl J. Tyler
*Attorney, Agent, or Firm*—James E. Bradley

[57] ABSTRACT

A subsurface well system contains well bore fluid and a pumping system which is lowered into the well bore on a conduit. The pumping system is supplied with electrical power through a conductor. The pumping system has a chamber, a discharge valve, and an intake valve for admitting the well bore fluid into the chamber. The chamber contains a reservoir that is filled with a reactive polymer gel that undergoes a significant change in volume in response to environmental changes. The gel expands when it is electrically stimulated, thereby forcibly expelling the fluid within the chamber. The gel contracts when it is not stimulated, thereby drawing fluid into the chamber. When electrical current is oscillated through the gel, the expansions and contractions repeat so that a pumping action of well bore fluid is achieved. The gel may also be formulated to react to an electromagnetic field. The gel of this embodiment contains metallic particles which increase in temperature when exposed to the magnetic field. The temperature increase significantly increases the volume of the gel. Applying electrical current to a coil which surrounds the reservoir causes a magnetic field to pass through the gel, thereby increasing the volume of the gel. When electrical current is oscillated through the coil, the gel expands and contracts so that a pumping action of well bore fluid is achieved.

10 Claims, 1 Drawing Sheet

REACTIVE MATERIAL RECIPROCATING SUBMERSIBLE PUMP

TECHNICAL FIELD

This invention relates in general to well pumps and in particular to a submersible pump which operates by repetitive swelling and shrinking of a gelatinous material.

BACKGROUND ART

There are a variety of prior art well pumps in use. One of the most popular types of prior art well pumps comprises a reciprocating rod system which is primarily used for low volume flow rates. If higher volume flow rates are required, electrical submersible pumps are more appropriate. Another type of prior art well pump is the progressive cavity pump which utilizes a rotating helical rod within an elastomeric sleeve to move fluids.

DISCLOSURE OF INVENTION

A subsurface well system contains well bore fluid and a pumping system which is lowered into the well bore on a conduit. The pumping system is supplied with electrical power through an insulated conductor which extends from the surface. The pumping system has an outer chamber, a discharge valve, and an intake valve for admitting the well bore fluid into the chamber. The chamber contains a reservoir or bladder. The reservoir is filled with an environmentally reactive polymer gel that undergoes a significant change in volume in response to environmental changes, such as an electrical or magnetic stimulus.

In one embodiment, the conductor is in electrical contact with the gel. Passing electrical current through the gel causes it to expand in volume significantly. When the gel is stimulated by the electrical current, the gel and the reservoir expand, thereby forcibly expelling the well bore fluid within the chamber through the discharge valve. When the gel is not stimulated, the gel and the reservoir contract or collapse, thereby drawing fluid into the chamber through the intake valve. When electrical current is oscillated through the gel, the expansions and contractions are repeated so that a pumping action of well bore fluid is achieved.

In an alternate embodiment, the gel is formulated to react to the presence of an AC or DC electromagnetic field. The gel of this embodiment contains metallic particles which increase in temperature when exposed to the magnetic field. The temperature increase significantly increases the volume of the gel. A length of the lower end of the conductor is formed into a coil which surrounds the reservoir. Applying electrical current to the coil causes a magnetic field to pass through the gel, thereby increasing its volume. When electrical current is oscillated through the coil, the gel expands and contracts so that a pumping action of well bore fluid is achieved.

BEST MODE FOR CARRYING OUT THE INVENTION

Figure 1:
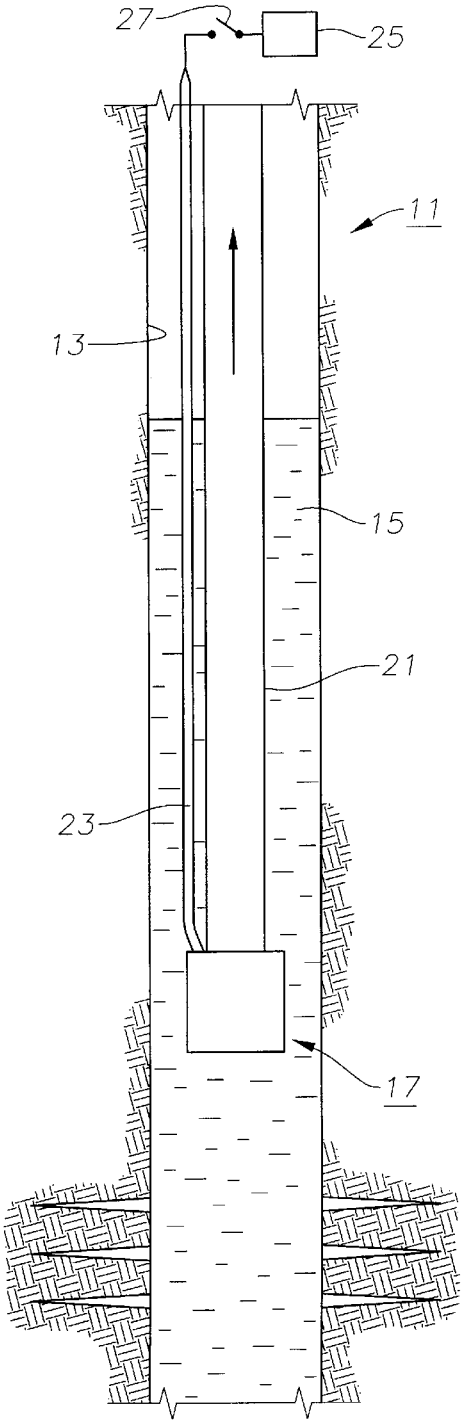
FIG. 1 is a schematic drawing of an apparatus constructed in accordance with the invention.

Referring to FIG. 1, a subsurface well system 11 having a well bore 13 containing well bore fluid 15 and a pumping system 17 is shown. Pumping system 17 is lowered into well bore 13 on a conduit 21. Pumping system 17 is supplied with electrical power through an insulated conductor 23 which extends from the surface. Conductor 23 is secured and sealed to pumping system 17 at an upper end. A power supply 25 and a switch 27 control the electricity and are located at the surface. Power supply 25 may be DC or AC, and is preferably single phase. Switch 27 is an automatically timed on/off switch which is preferably variable.

Figure 2:
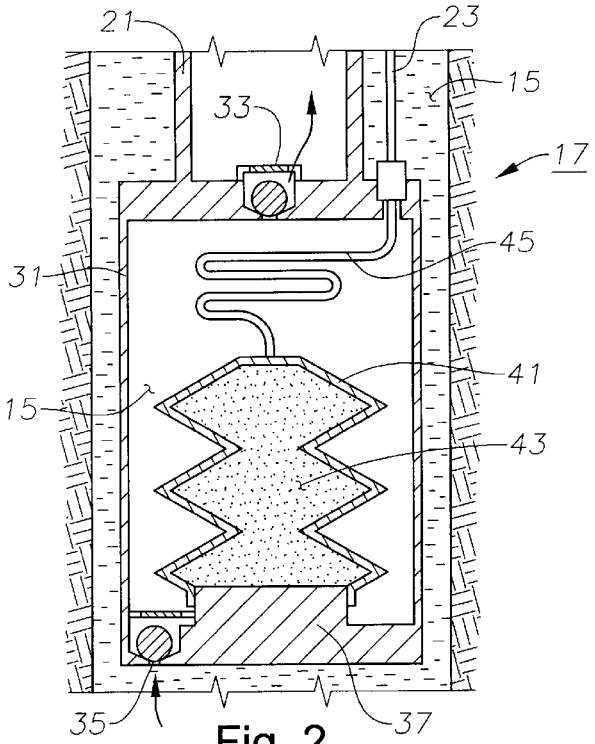
FIG. 2 is a schematic sectional view of a pump of the apparatus of FIG. 1.

Referring to FIG. 2, pumping system 17 comprises an outer chamber 31, a discharge valve 33, and an intake valve 35 for admitting well bore fluid 15 into chamber 31. The interior of chamber 31 communicates with an interior of conduit 21 through discharge valve 33. Intake valve 35 is located on a lower end 37 of chamber 31. In the preferred embodiment, valves 33, 35 comprise check valves.

Chamber 31 contains an inner, variable volume reservoir 41 which is secured to lower end 37 of chamber 31. In the embodiment shown, reservoir 41 is an elastomeric bellows or bladder. Reservoir 41 is filled with an environmentally reactive polymer gel 43 that undergoes a significant change in volume in response to environmental changes, such as an electrical or magnetic stimulus. In the preferred embodiment, gel 43 is a mixture of N-isopropylacrylamide, water, an appropriate polymerization initiator and an accelerator. Gel 43 of this nature is commercially available through Gel Sciences, Bedford, Mass. Reservoir 41 protects gel 43 from contact with well fluid 15.

In the embodiment of FIG. 2, a short length of the lower end of conductor 23 is formed into a flexible insulated lead 45. Lead 45 extends downward from the upper end of chamber 31 and extends sealingly into an upper end of reservoir 41 in electrical contact with gel 43. Chamber 31 is fabricated from an electrically conductive metal. Lower end 37 of chamber 31 is also in contact with gel 43 and acts as a ground. Passing electrical current through gel 43 causes it to expand in volume significantly. Gel 43 and, thus, reservoir 41 have two states: an unstimulated, contracted state wherein a relatively small volume of chamber 31 is filled, and a stimulated, expanded state wherein a relatively large volume of chamber 31 is filled.

In operation, power supply 25 alternatively passes electricity through gel 43 from conductor 23 to the ground at lower end 37. When gel 43 is stimulated by the electrical current, gel 43 and reservoir 41 expand, thereby forcibly expelling the well bore fluid 15 within chamber 31 through discharge valve 33. Intake valve 35 is in a closed position and discharge valve 33 is in an open position while gel 43 and reservoir 41 are expanding. When gel 43 is not stimulated, gel 43 and reservoir 41 contract or collapse, thereby drawing fluid 15 into chamber 31 through intake valve 35. Intake valve 35 is in an open position and discharge valve 33 is in a closed position while gel 43 and reservoir 41 are contracting. When the electricity is oscillated through gel 43, the expansions and contractions are repeated so that a pumping action of well bore fluid 15 is achieved.

Figure 3:
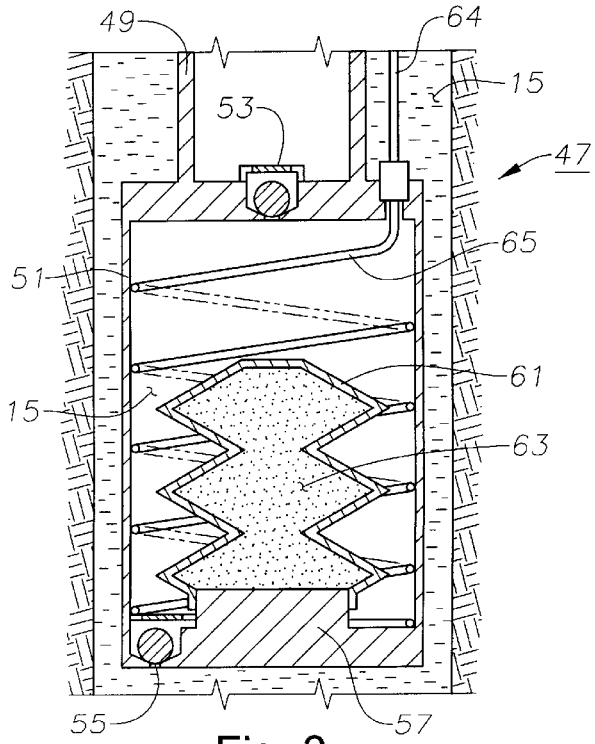
FIG. 3 is a schematic sectional view of an alternate embodiment of a pump of the apparatus of FIG. 1.

An alternate embodiment of the invention is shown in FIG. 3. In this embodiment, the gel is formulated to react to the presence of an AC or DC electromagnetic field. A pumping system 47 is similar to pumping system 17. Pumping system 47 comprises an outer chamber 51, a discharge valve 53, and an intake valve 55 for admitting well bore fluid 15 into chamber 51. The interior of chamber 51 communicates with an interior of a conduit 49 through discharge valve 53. Intake valve 55 is located on a lower end 57 of chamber 51. In the preferred embodiment, valves 53, 55 comprise check valves.

Chamber 51 contains an inner, variable volume bladder or reservoir 61 which is secured to lower end 57 of chamber 51. Reservoir 61 is filled with an environmentally reactive polymer gel 63 that undergoes a significant change in volume in response to a magnetic field stimulus. In the preferred embodiment, reservoir 61 is a thin flexible bladder. Gel 63 contains metallic particles which increase in temperature when exposed to the magnetic field. The temperature increase significantly increases the volume of gel 63. Gel 63 does not come into contact with well bore fluid 15. An insulated electrical conductor 64 extends downward from the surface to chamber 51. A length of the lower end of conductor 64 is formed into a coil 65 with an outer diameter that is approximately equal to an inner diameter of chamber 51. Coil 65 extends downward from the upper end of chamber 51 to the lower end 57 of chamber 51 and surrounds reservoir 61. Applying electrical current to coil 65 causes a magnetic field to pass through gel 63, thereby increasing its volume. Gel 63 and, thus, reservoir 61 have two states: an unstimulated, contracted state wherein a relatively small volume of chamber 51 is filled, and a stimulated, expanded state wherein a relatively large volume of chamber 51 is filled.

In operation, a power supply (not shown) selectively passes electrical current through conductor 64 to produce a magnetic field by coil 65. When gel 63 is stimulated by the magnetic field, gel 63 and reservoir 61 expand, thereby forcibly expelling the well bore fluid 15 within chamber 51 through discharge valve 53. Intake valve 55 is in a closed position and discharge valve 53 is in an open position while gel 63 and reservoir 61 are expanding. When gel 63 is not stimulated, gel 63 and reservoir 61 contract or collapse, thereby drawing fluid 15 into chamber 51 through intake valve 55. Intake valve 55 is in an open position and discharge valve 53 is in a closed position while gel 63 and reservoir 61 are contracting. When the electricity is oscillated through coil 65, the expansions and contractions are repeated so that a pumping action of well bore fluid 15 is achieved.

The invention has several advantages. This pump system has no submerged reciprocating seals, no moving components exposed to the well casing, and much simpler surface equipment than all other forms of lift. Because of its simplicity, this pump system should be more reliable and less expensive than prior art low volume pump alternatives.

While the invention has been shown in only two of its forms, it should be apparent to those skilled in the art that it is not so limited, but is susceptible to various changes without departing from the scope of the invention. For example, if the interior of chamber 31 must be protected from well bore fluid 15, a simple seal section chamber (not shown) comprising a bag type or labyrinth chamber of commercial types used with electrical centrifugal submersible pumps can be located above it. The expansion and contraction of gel 43 would cycle the oil contained within the seal section in and out similar to a motor thermal cycle. The well bore fluid 15 discharged into the seal section head as the gel expands would pass through a check valve. The seal section chamber drain valve would be left open and contain another check valve. Well bore fluid would be drawn into this check valve as the gel contracts. The seal section would have no dynamic seals.

I claim:

1. A pumping system comprising:

a pump having a chamber, an intake valve for admitting a fluid into the chamber, and a discharge valve for discharging the fluid from the chamber;

reactive polymer gel contained within the chamber, the gel having a first volume when exposed to an electromagnetic field and a second volume when the electromagnetic field is removed, the first volume being significantly different from the second volume;

an electromagnetic coil surrounding the gel, the coil being connected to a power supply which selectively and alternately exposes the gel to an electromagnetic field for causing the gel to expand and expel a portion of the fluid within the chamber through the discharge valve; and a variable volume reservoir which encloses the gel; and wherein the coil is located within the chamber and surrounds the reservoir.

2. A pumping system comprising:

a pump having a chamber, an intake valve for admitting a fluid into the chamber, and a discharge valve for discharging the fluid from the chamber;

reactive polymer gel contained within the chamber, the gel having a first volume when exposed to an electromagnetic field and a second volume when the electromagnetic field is removed, the first volume being significantly different from the second volume;

an electromagnetic coil surrounding the gel, the coil being connected to a power supply which selectively and alternately exposes the gel to an electromagnetic field for causing the gel to expand and expel a portion of the fluid within the chamber through the discharge valve; and a flexible bladder which encloses the gel.

3. A method for pumping well bore fluid in a well bore, comprising:

(a) lowering a pump on a conduit into the well bore, the pump having a chamber which has an intake valve for admitting well fluid into the chamber, a discharge valve for discharging well fluid into the conduit, and an environmentally reactive, expansible polymer gel;

(b) exposing the gel to an environmental change, thereby causing the gel to expand, expelling a portion of the well fluid within the chamber through the discharge valve into the conduit; and then (c) removing the environmental change from the gel, thereby causing the gel to contract and well bore fluid to be drawn into the chamber through the intake valve.

4. The method of claim 3 wherein exposing the gel to the environmental change comprises passing electricity through the gel.

5. The method of claim 3 wherein exposing the gel to the environmental change comprises exposing the gel to a magnetic field.

6. The method of claim 3 wherein the intake valve is in a closed position and the discharge valve is in an open position while the gel is expanding.

7. The method of claim 3 wherein the intake valve is in an open position and the discharge valve is in a closed position while the gel is contracting.

8. The method of claim 3 wherein the gel is a mixture of N-isopropylacrylamide, water, an appropriate polymerization initiator and an accelerator.

9. A method for pumping well bore fluid in a well bore, comprising:

(a) providing a pump having a chamber with a discharge valve for discharging well fluid, an intake valve for admitting well fluid into the chamber from the well bore, and containing a reactive polymer gel which increases in volume when exposed to an electrical field;

(b) lowering the pump on a conduit into the well;

(c) exposing the gel to an electrical field, thereby causing the gel to expand and well fluid within the chamber to escape through the discharge valve; and then (d) removing the electrical field, thereby causing the gel to contract and well fluid to be drawn into the chamber through the intake valve.

10. A method for pumping well bore fluid in a well bore, comprising:

(a) lowering a pump on a conduit into the well bore, the pump having a chamber which has an intake valve for admitting well fluid into the chamber, a discharge valve for discharging well fluid, and an environmentally reactive, expansible polymer gel;

(b) exposing the gel to an environmental change, thereby causing the gel to expand, expelling a portion of the well fluid within the chamber through the discharge valve; and then (c) removing the environmental change from the gel, thereby causing the gel to contract and well bore fluid to be drawn into the chamber through the intake valve.

* * * * *